US006119501A

United States Patent [19]

Hansen et al.

[11] Patent Number: 6,119,501

[45] Date of Patent: Sep. 19, 2000

[54] METHOD OF DEFORMING AN INITIAL PIPE HAVING A CIRCULAR CROSS-SECTION INTO A U-SHAPED SECTION AND DEVICE FOR CARRYING OUT THE METHOD

[75] Inventors: Rainer Hansen; Georg Wecker, both of Paderborn, Germany

[73] Assignee: Benteler AG, Paderborn, Germany

[21] Appl. No.: 09/307,389

[22] Filed: May 7, 1999

[30] Foreign Application Priority Data

May 7, 1998 [DE] Germany ..... 198 20 415

[51] Int. Cl.[7] ..... B21D 9/00

[52] U.S. Cl. ..... 72/370.04; 72/370.23; 72/399; 72/415

[58] Field of Search ..... 72/370.23–370.25, 72/369, 399, 414, 415, 370.04, 370.01, 304, 315; 29/890.14

[56] References Cited

U.S. PATENT DOCUMENTS

| | | | |
|---|---|---|---|
| 2,285,275 | 6/1942 | Harder . | |
| 2,744,429 | 5/1956 | Seely | 72/370.23 |
| 2,748,455 | 6/1956 | Draper | 72/415 |
| 4,085,603 | 4/1978 | Vanek | 72/370.23 |
| 4,095,450 | 6/1978 | Opland | 72/370.23 |
| 4,131,007 | 12/1978 | Laundy | 72/370.23 |
| 4,165,627 | 8/1979 | Boshold | 72/370.04 |
| 4,998,871 | 3/1991 | Ledoux | 72/370.23 |

FOREIGN PATENT DOCUMENTS

| | | | |
|---|---|---|---|
| 1312422 | 11/1962 | France | 72/414 |
| 8852 | 11/1900 | Germany | 72/414 |

*Primary Examiner*—Daniel C. Crane
*Attorney, Agent, or Firm*—Friedrich Kueffner

[57] ABSTRACT

A method of deforming an initial pipe having a circular cross-section into an U-shaped section and a device for carrying out the method wherein the inner surface of one half of the initial pipe rests in a positively engaging manner against the inner surface of the opposite half of the pipe, with the exception of lateral loop-shaped ear portions. The initial pipe is secured in its position by mandrels inserted in the ends of the pipe. Initially, the initial pipe is with its lower half at least over areas thereof supported by an abutment and the top half of the initial pipe is pressed in by a ledge-like top die with a convexly curved front portion located opposite the abutment until the top half of the initial pipe is pressed in until it makes contact with the diametrically oppositely located bottom half of the pipes so as to produce a U-shaped top half. Subsequently, the top die and another bottom die having the external contour of the section are moved toward each other to finish the U-shaped section while the mandrels which remain in the ends of the pipe are moved as required.

8 Claims, 5 Drawing Sheets

METHOD OF DEFORMING AN INITIAL PIPE HAVING A CIRCULAR CROSS-SECTION INTO A U-SHAPED SECTION AND DEVICE FOR CARRYING OUT THE METHOD

BACKGROUND OF THE INVENTION

1. Field of the Invention

The present invention relates to a method of deforming an initial pipe having a circular cross-section into an U-shaped section and to a device for carrying out the method.

2. Description of the Related Art

U-shaped sections produced by a chipless deforming process from circular initial pipes are used, for example, as suspension or control arms for the rear axles of automobiles.

In the deforming process which has been carried out in the past, an initial pipe is placed on the edges of an open bottom die which has an internal contour corresponding to the external contour of the U-shaped section. The opening dimension of the opening of the die is always smaller than the diameter of the initial pipe. Using a ledge-like top die, which has a convexly curved front portion, the initial pipe is pressed in from the side located opposite the bottom die. The top die has an external contour which corresponds to the internal contour of the section.

In view of the fact that the opening dimension of the bottom die is always smaller than the diameter of the initial pipe, it was necessary in the past during the deformation of the initial pipe to pull generally about a third of the pipe diameter over the edges of the bottom die. This results immediately in front of the end position of the top die in a situation for so-called ear loops in such a way that, due to the section modulus occurring at the ear loops, the material located at the bottom is stretched or elongated at the inner side thereof. This elongation is particularly due to the fact that, by moving the top and bottom dies toward each other, the material in the gap available on both sides between the top die and the bottom die is prevented from carrying out a sliding and rolling movement by the high friction at the walls of the top die and the bottom die. This stretching or elongation always takes place transversely of the rolling direction of the metal from which the initial pipe is manufactured, so that the mechanical technological characteristics are significantly limited as compared to those in the longitudinal direction. Consequently, depending on the mechanical characteristics, the maximum plastic transverse elongation is in the border area of the actually occurring elongation values.

In the case of surface roughness, which may be relatively great particularly when using initial pipes manufactured from hot-rolled sheet metal, a critical tear situation may occur in the upper border range of the roughness values.

SUMMARY OF THE INVENTION

Therefore, it is the primary object of the present invention, to provide a method of deforming an initial pipe having a circular cross-section into a U-shaped section, and a device for carrying out the method, in which a significant reduction of the transverse stress acting on the material is achieved and the manufacture is more economical as a result.

In accordance with the present invention, an initial pipe having a circular cross-section is deformed into a U-shaped section in which the inner surface of one half of the initial pipe rests in a positively engaging manner against the inner surface of the opposite half of the pipe, with the exception of lateral loop-shaped ear portions. The initial pipe is secured in its position by mandrels inserted in the ends of the pipe. Initially, the initial pipe is with its lower half at least over areas thereof supported by an abutment and the top half of the initial pipe is pressed in by a ledge-like top die with a convexly curved front portion located opposite the abutment until the top half of the initial pipe is pressed in and makes contact with the diametrically oppositely located bottom half of the pipe so as to produce a U-shaped top half. Subsequently, the top die and another bottom die having the external contour of the section are moved toward each other to finish the U-shaped section while the mandrels which remain in the ends of the pipe are moved as required.

Consequently, in accordance with the invention, the initial pipe positioned between mandrels is supported with one half thereof on an abutment at least over areas thereof. A support over at least areas thereof is intended to mean a support in which a contact of the initial pipe+ with oppositely located longitudinal edges is avoided and the initial pipe is essentially placed in a bowl-like receiving portion. Subsequently, the ledge-like top die is moved against the initial pipe and the pipe is then pressed in from the side opposite the abutment by the top die to form a U-shape. This pressing process takes place until the half of the initial pipe on which the top die acts makes contact with the inner surface of the half of the pipe resting on the abutment.

In this method step, the initial pipe is initially pressed by the top die into an essentially oval shape. When the top die is moved further, the pipe is pressed in until, in the end position of the top die, an especially linear contact between the inner surfaces takes place. Because of the particular manner in which the initial pipe is embedded in the abutment, the ear loops next to the top die are relatively large. This avoids an excessively narrow shaping of the pipe material, so that the principal transverse stress acting on the material is significantly reduced.

It is important in this deformation step that the initial pipe itself remains in its position; this is ensured by means of the mandrels positioned at the ends of the pipe. At the ends, the initial pipe maintains its original cross-section.

In the second deformation step, the top die and another bottom die having an internal contour corresponding to the external contour of the U-shaped section to be manufactured are moved relative toward each other. This displacement of top die and bottom die takes place until the inner surface of the pipe half on which the top die acts comes into contact in a positively engaging manner with the inner surface of the pipe half resting in the internal contour of the bottom die. Only the loop-shaped ear portions remain, however, these ear portions now have a very small size.

It is important in this connection that the shaping of the ear portions takes place without friction because they do not have any contact with the tools. The ear portions are manufactured by rolling without impairment.

If necessary, the U-shaped section maybe subjected to a calibration. This can be carried out in dependence on the contour and the purpose of the manufactured section. This results in a further significant reduction of the transverse stress acting on the material.

In accordance with an advantageous embodiment of the invention, the initial pipe is first placed with a pipe portion smaller than 180° in a single-piece abutment having a circular section-shaped trough. This provides the advantage that the ear loops are initially formed very large.

Subsequently, the top die is moved against the initial pipe and the pipe is pressed in until contact between the inner surfaces takes place.

Subsequently, the abutment with the trough is replaced by a bottom die having a U-shaped internal contour which corresponds to the external contour of the U-section. The top die and the bottom die are then displaced relative to each other until, with the exception of the ear loops, the inner surface of the pipe half on which the top die acts comes into contact with the inner surface of the pipe half resting in the bottom die.

In accordance with another advantageous embodiment of the present invention, the abutment is part of a three-part bottom die which, in a second deformation step, determines the external contour of the section.

In a first deformation step, the initial pipe is supported on the bottom die over three portions of a half of the pipe which are offset relative to each other by approximately 90°. The half of the pipe located opposite the bottom die is pressed in by the top die until the inner surfaces have a linear contact with each other. All parts of the bottom die and the top die are then moved relative to each other and the U-shaped section is produced.

In the second deformation step, the pipe wall is pressed laterally against the contour of the top die by shaping jaws which are part of the three-part bottom die, wherein only a minimum relative movement occurs between the lateral shaping jaws and the pressed-in initial pipe. The loop-shaped ear portions are subjected to a soft rolling process because the rolling radii can be selected generously large. In view of the fact that the ear portions of the section do not have any contact with the tools, no friction occurs. The rolling process takes place unimpaired.

Since rolling takes place from the first contact of the top die with the initial pipe up to the deforming use of the lateral shaping jaws, no weakening of the wall takes place until then. At the moment the shaping jaws are used, the contour of the section is finished to such an extent that a vertical pulling at the inner transitions to the ear portions does not take place. During the relative movement of the top die and the bottom die, the rolling radius is then continuously reduced, but reaches its narrow final contour only after the inner surfaces rest against each other.

In accordance with another feature, all required or desired embossments can be made in the profile in the end position of the top die by means of die cushions or other techniques.

The device for carrying out the method includes a ledge-like top die with a convexly curved front portion, an abutment with a circular section-shaped trough and a bottom die having a U-shaped internal contour and diverging arched end portions, wherein the abutment and the bottom die are exchangeable and movable relative to the top die.

The trough which does not extend over the entire diameter of the initial pipe makes it possible that the initial pipe can assume an oval shape in the first deformation step and large lateral loop-shaped ear portions can be formed slowly. Subsequently, the top die is moved back and the abutment is replaced by a bottom die having a U-shaped internal contour and diverging arched end portions. When the U-shaped pressed-in initial pipe is placed in the bottom die and the top die or the bottom die are displaced or both parts are displaced against each other, the preshaped section slides into the U-shaped internal contour of the bottom die until finally, except for the ear loops, the inner surface of the pipe half on which the top die acts rests firmly against the inner surface of the pipe half resting in the bottom die. Trough-shaped indentations in the bottom die and the top die ensure that the ear loops are not squeezed as they are being formed.

In accordance with another embodiment of the present invention, arranged opposite the ledge-like top die with a convexly curved front portion is a three-part bottom die which is displaceable relative to the top die and also assumes the function of an abutment. The bottom die is composed of a support jaw which is located frontally opposite the top die and lateral shaping jaws which rest against a counter-abutment which supports the top die. The shaping jaws have the lateral external contours of the later section, while the support jaw shapes the arched portion between the legs of the section. The top die also has trough-like indentations for the lateral ear loops.

In accordance with a preferred feature, the support jaw is roof-shaped and an arched trough is provided at the top of the support jaw. The contour of the trough corresponds to the curvature of the arched portion of the section.

In accordance with a useful feature, the lateral shaping jaws are provided with inclined surfaces which rest against roof-shaped inclined surfaces of the support jaw and against diverging inner surfaces of the counter-abutment. This ensures that the usually two-stage deformation process is carried out properly. If necessary, the entire deforming process can also be carried out in a single deforming step.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
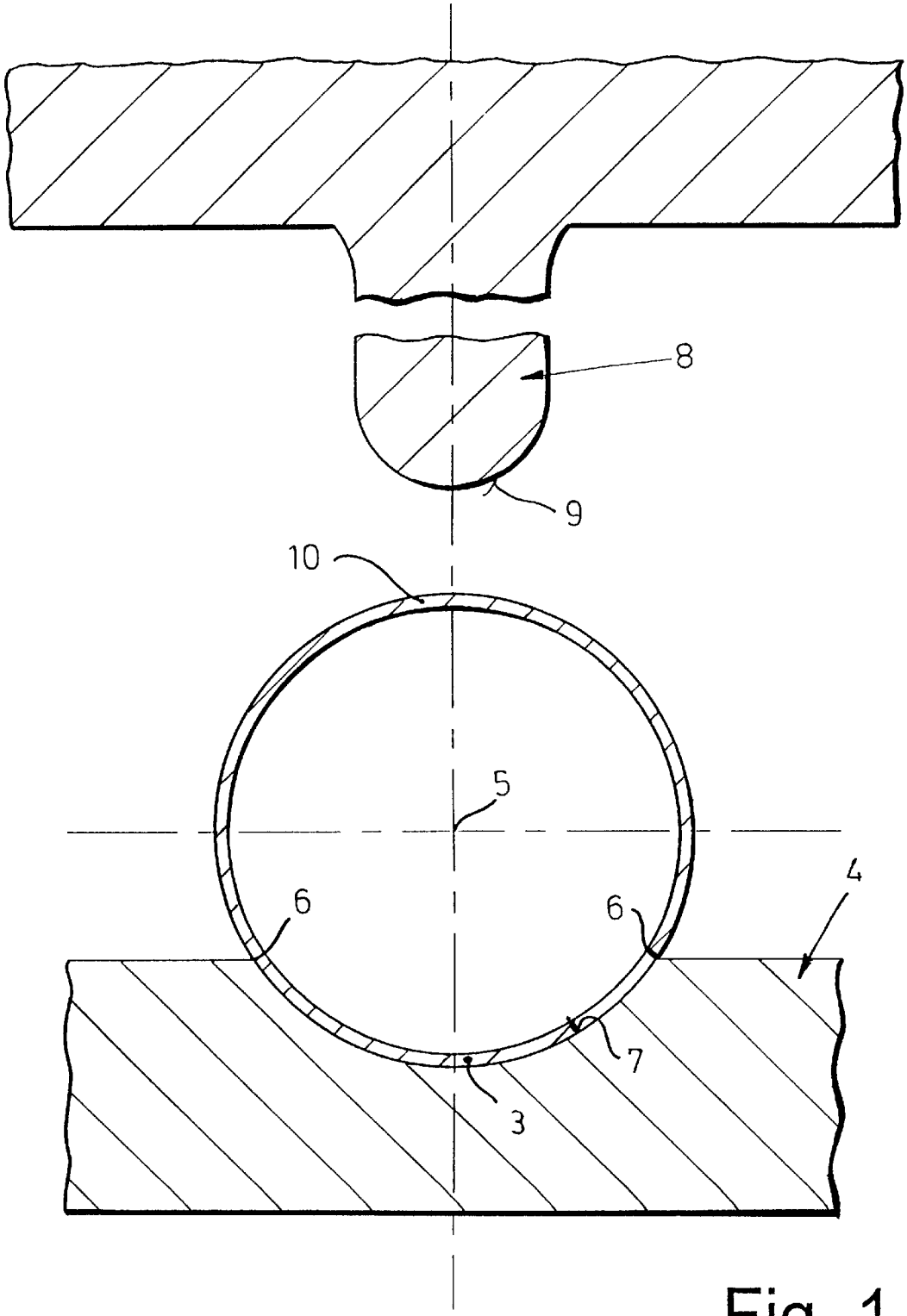
FIG. 1 is a vertical schematic sectional view of a device for deforming a circular initial pipe into a U-shaped section, shown prior to the deformation.
Figure 3:
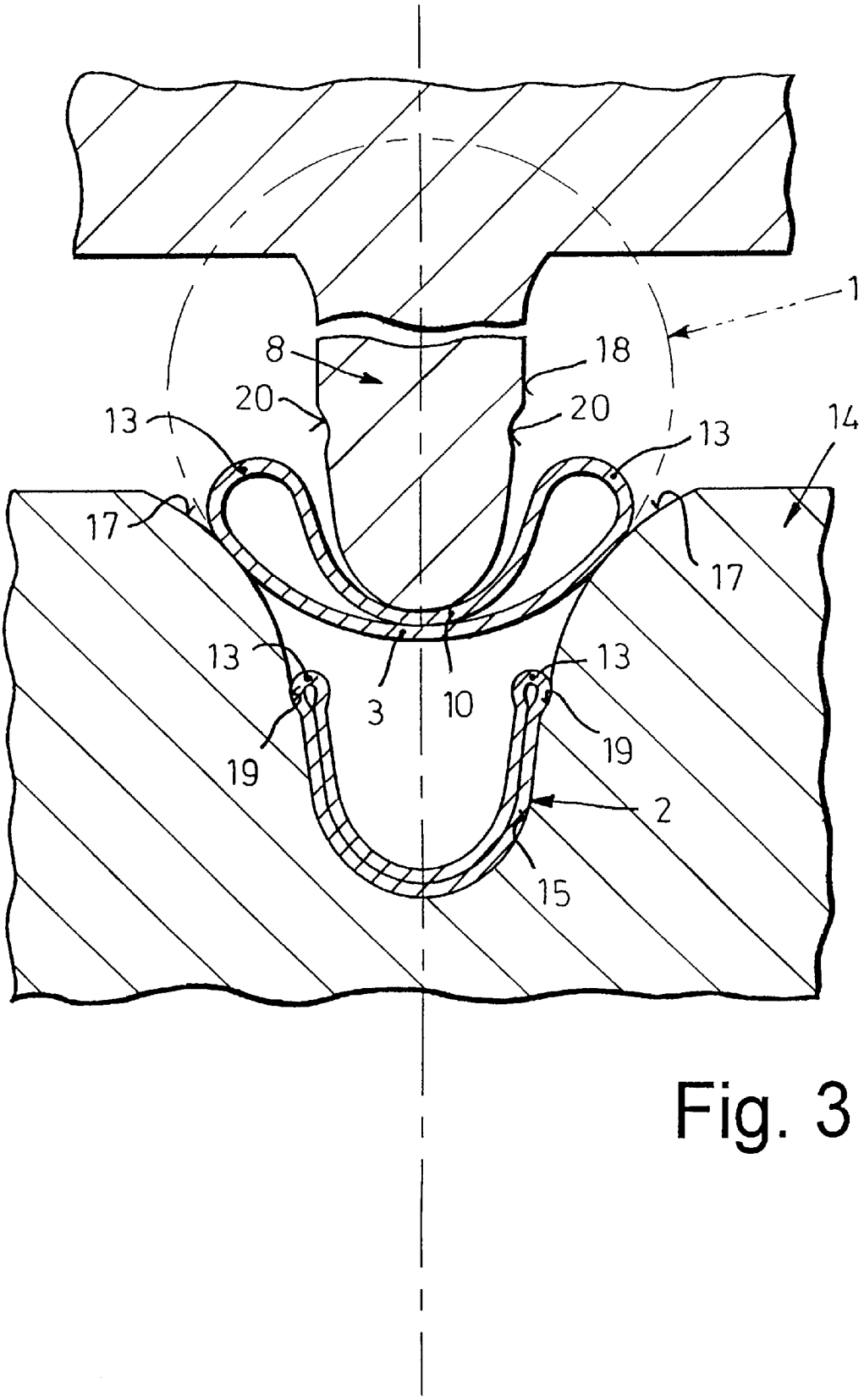
FIG. 3 is a sectional view of the device of FIG. 1, shown during the deformation and after a second deforming step.

FIG. 1 of the drawing shows an initial pipe 1 of steel which has a circular cross-section and which is to be deformed into a U-shaped section 2 as shown in FIG. 3.

For this purpose, as shown in FIG. 1, the initial pipe 1 is initially placed with a pipe half 3 into a circular section-shaped trough of a single-piece abutment 4. The trough 7 is smaller than 180°. Consequently, the pipe axis 5 is located at a distance above the opening edges 6 of the trough 7. The distance between the opening edges 6 is smaller than the diameter of the initial pipe 1.

The initial pipe 1 is held in the position shown in FIG. 1 by means of shaping mandrels, not shown in detail, inserted in the ends of the initial pipe 1.

Located above the abutment 4 is a ledge-shaped top die 8 having a convexly curved front portion 9. The contour of the top die 8 corresponds to the internal contour of the section 2 to be manufactured.

Figure 2:
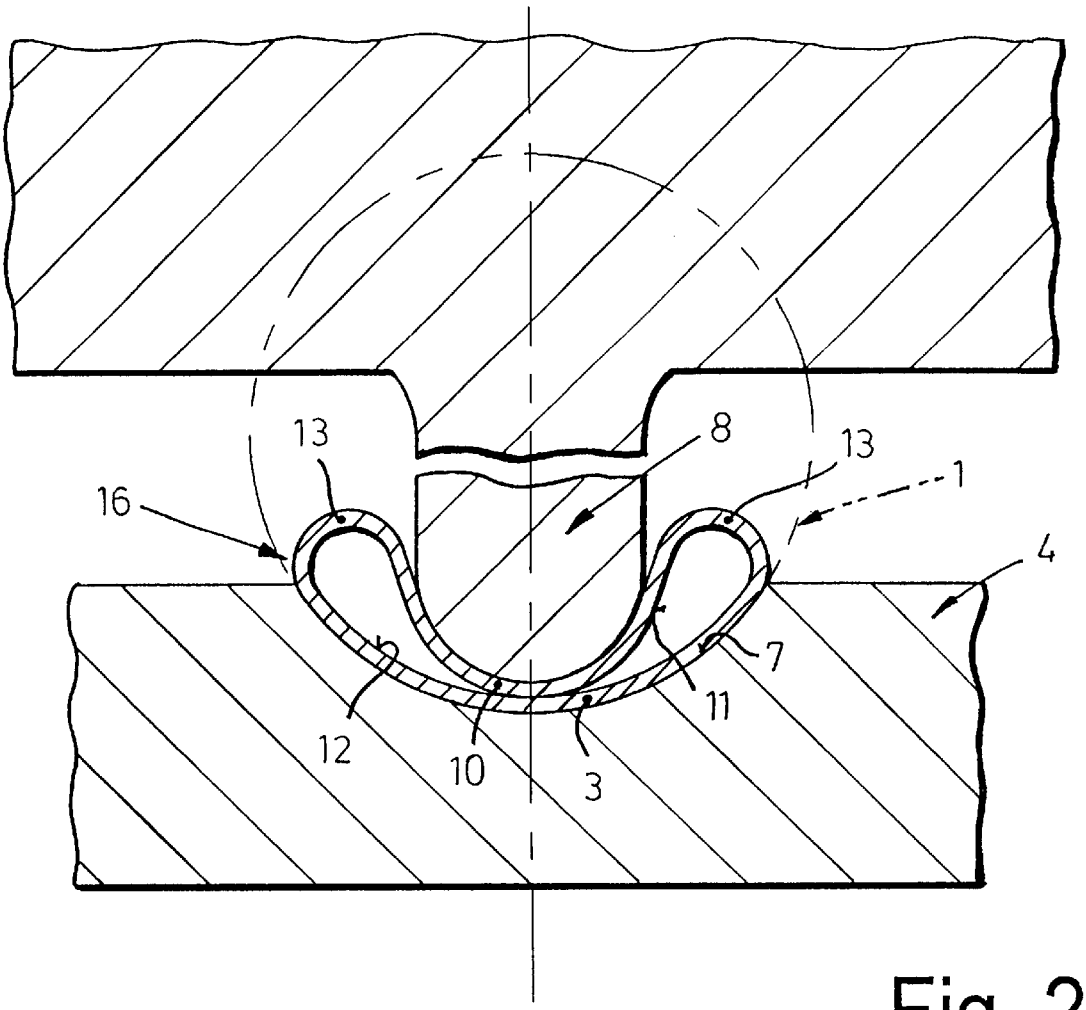
FIG. 2 is a sectional view of the device of FIG. 1, shown at the end of a first deforming step.

By displacing the top die 8 in the direction toward the abutment 4, the pipe half 10 of the initial pipe 1 facing the top die 8 is pressed in to form a U-shape as shown in FIG. 2, until the inner surface 11 of this pipe half 10 has a linear contact with the inner surface 12 of the pipe half 3 resting in the trough 7. Loop-shaped ear portions 13 are formed without squeezing above the abutment 4 and laterally of the top die 8.

Subsequently, the top die 8 is once again moved away from the abutment 4 and the abutment 4 is replaced by a bottom die 14 which is shown in FIG. 3 and has a U-shaped internal contour 15 which is adapted to the desired external contour of the section 2. The initial pipe 16 which has been pressed in in accordance with FIG. 2 is then placed against the diverging arched opening portions 17 of the inner contour 15 of the bottom die 14. Subsequently, the top die 8 and the bottom die 14 are moved relative to each other. This produces the U-shaped section 2. Since this section 2 has lateral loop-shaped ear portions, the internal contour 15 of the bottom die 14 as well as the surface 18 of the top die 8 are provided with trough-shaped indentations 19, 20 which are adapted to the ear portions 13.

Figure 4:
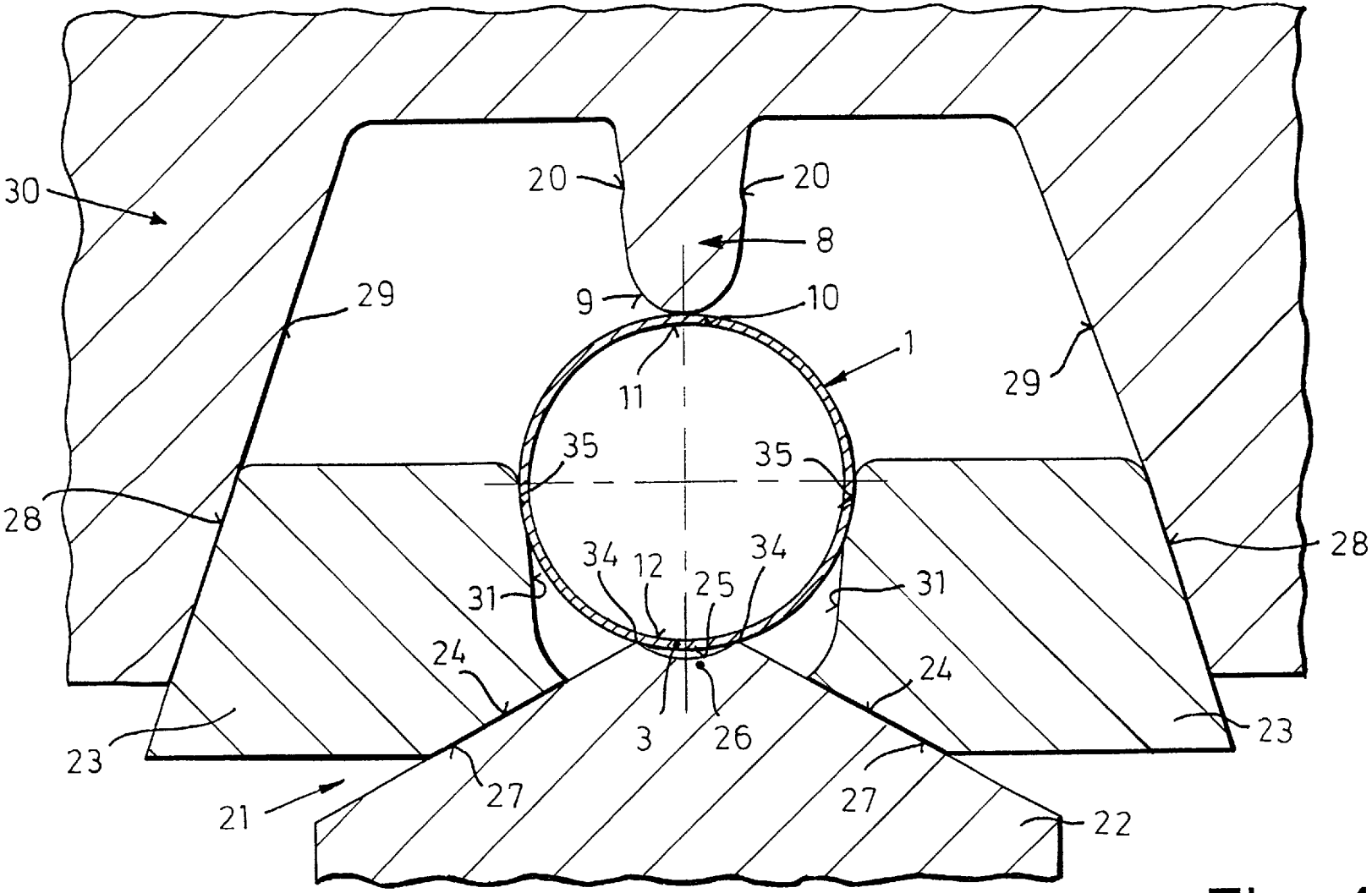
FIG. 4 is a vertical schematic sectional view of another embodiment of a device for deforming a circular initial pipe into a U-shaped section, shown prior to the deformation.
Figure 5:
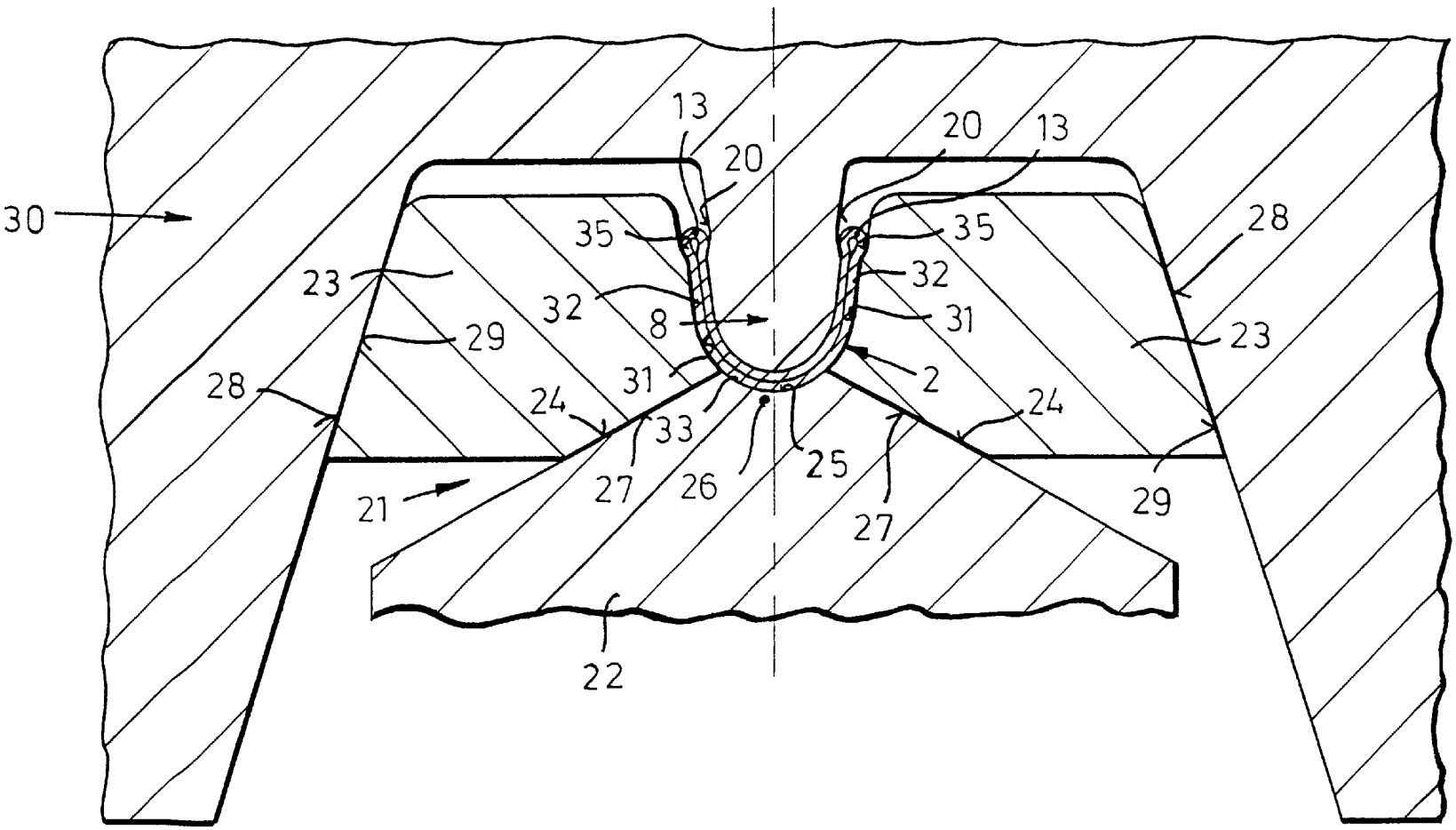
FIG. 5 is a sectional view of the device of FIG. 4, shown after the deformation.

FIGS. 4 and 5 of the drawing show a device for deforming a circular initial pipe 1 of steel into a U-shaped section 2, wherein the device includes a three-part bottom die 21 which also acts to serve as an abutment.

The bottom die 21 is composed of a middle support jaw 22 and two lateral shaping jaws 23. The support jaw 22 is roof-shaped with equally inclined surfaces 24 and an arch-shaped trough 25 at the top 26. The inclined surfaces 27 of the shaping jaws 23 rest on the inclined surfaces 24. The shaping jaws 23 rest on the other side thereof with inclined outer surfaces 28 against diverging inner surfaces 29 of a counter abutment 30 which also supports a ledge-shaped top die 8. The inner sides 31 of the shaping jaws 23 are adapted to the external contour of the legs 32 of the U-shaped section. The trough 25 in the support jaw 23 is adapted to the contour of the arched portion 33 of the section 2.

For manufacturing the section in accordance with FIG. 5, initially the bottom die 21 and the counter abutment 30 with the top die 8 are moved apart from each other and the circular initial pipe 1 is placed in the bottom die 21 in the position seen in FIG. 4. In this state, the initial pipe 1 rests against the longitudinal edges 34 which define the trough 25 and are located at the top 26 of the support jaw 22 and against two trough-shaped indentations 35 at the inner sides 31 of the shaping jaws 23.

Subsequently, the counter abutment 30 is displaced relative to the bottom die 21, wherein the top die 8, analogous to the illustration in FIG. 2, presses the pipe half 10 adjacent the top die 8 into a U-shape until the inner surface 11 of this pipe half 10 of the initial pipe 1 rests linearly against the inner surface 12 of the pipe half 3 resting on the bottom die 21.

By a subsequent further relative displacement of the top die 8 and the bottom die 21, wherein also the shaping jaws 23 are displaced relatively to the support jaw 22 and the counter abutment 30, the cross-sectional contour of the section 2 shown in FIG. 5 is produced. It can be seen that the loop-shaped ear portions 13 rest in the indentations 35 of the shaping jaws 23 and in indentations 20 of the top die 8.

Also in the device according to FIGS. 4 and 5, the position of the initial pipe 1 shown in FIG. 4 is ensured during the preshaping process by shaping mandrels, not shown, which are moved into the ends of the initial pipe 1.

While specific embodiments of the invention have been described in detail to illustrate the inventive principles, it will be understood that the invention may be embodied otherwise without departing from such principles.

We claim:

1. A method of deforming an initial pipe having a circular cross-section into a U-shaped section, wherein an inner surface of a first pipe half of the initial pipe rests against an inner surface of a second half of the initial pipe with the exception of lateral loop-shaped ear portions where the inner surfaces of the first and second pipe halves do not contact each other, the method comprising securing the initial pipe by mandrels inserted into ends of the pipe, supporting at least areas of the second half of the pipe by an abutment and pressing the first half of the initial pipe by a ledge-like top die having a convexly curved front portion located opposite the abutment until the first half of the initial pipe is pressed in and makes contact with the inner surface of the second half of the pipe so as to produce a U-shaped first half, subsequently moving the top die and a bottom die having external contours of the section toward each other until the U-shaped section is finished, while simultaneously moving as required the mandrels which remain in the ends of the pipe.

2. The method according to claim 1, comprising subjecting the U-shaped section to a calibration.

3. The method according to claim 1, comprising supporting the initial pipe by a single-piece abutment having a circular section-shaped trough and pressing in the first half of the pipe by the top die to form a U-shape of the first half, subsequently replacing the abutment by the bottom die having a U-shaped internal contour and finally shaping the pipe to form the U-shaped section by moving the top die and the bottom die toward each other.

4. The method according to claim 1, comprising supporting the initial pipe by a three-part bottom die comprising three portions forming the abutment, wherein the initial pipe is supported on the bottom die over the three portions which are offset by about 90° relative to each other, pressing the first half of the pipe by the top die, subsequently moving the three portions of the bottom die and the top die relative to each other and finally shaping the pipe into the U-shaped section.

5. A device for deforming an initial pipe having a circular cross-section into a U-shaped section, wherein an inner surface of a first pipe half of the initial pipe rests against an inner surface of the second half of the initial pipe with the exception of lateral loop-shaped ear portions where the inner surfaces of the first and second pipe halves do not contact each other, the device comprising a ledge-like top die having a convexly curved front portion, an abutment having a circular section-shaped trough for an initial deforming step and a bottom die having a U-shaped internal contour and diverging arched end portions of the U-shaped internal contour for a final deforming step producing the U-shaped section, wherein the abutment and the bottom die are mounted so as to be exchangeable for performing the initial and final deforming steps, respectively, and movable relative to the top die.

6. A device for deforming a initial pipe having a circular cross-section into a U-shaped section, wherein an inner surface of a first pipe half of the initial pipe rests against an inner surface of a second half of the initial pipe with the exception of lateral loop-shaped ear portions where the inner surfaces of the first and second pipe halves do not contact each other, the device comprising a ledge-shaped top die having a convexly curved front portion, a three-part bottom die serving as an abutment, wherein the top die and the bottom die are mounted so as to be movable relative to each other, wherein the three-part bottom die is comprised of a support jaw located frontally opposite the top die and two lateral shaping jaws in contact with the support jaw and with a counter abutment supporting the top die.

7. The device according to claim 6, wherein the support jaw is roof-shaped and the support jaw has at a top thereof a curved trough.

8. The device according to claim 7, wherein the lateral shaping jaws have inclined surfaces resting on roof-shaped inclined surfaces of the support jaw and against diverging inner surfaces of the counter abutment.

* * * * *